US007644826B2

(12) United States Patent
Koch et al.

(10) Patent No.: US 7,644,826 B2
(45) Date of Patent: Jan. 12, 2010

(54) BASKET FOR A DISHWASHING MACHINE HAVING VARIOUS RECEPTACLES AND/OR HOLDERS

(75) Inventors: Stephan Koch, Detmold (DE); Dirk Wegener, Bielefeld (DE)

(73) Assignee: Miele & Cie. KG, Gutersloh (DE)

( * ) Notice: Subject to any disclaimer, the term of this patent is extended or adjusted under 35 U.S.C. 154(b) by 452 days.

(21) Appl. No.: 11/579,718

(22) PCT Filed: Apr. 19, 2005

(86) PCT No.: PCT/EP2005/004145

§ 371 (c)(1),
(2), (4) Date: Nov. 3, 2006

(87) PCT Pub. No.: WO2005/107568

PCT Pub. Date: Nov. 17, 2005

(65) Prior Publication Data

US 2007/0199584 A1 Aug. 30, 2007

(30) Foreign Application Priority Data

May 3, 2004 (DE) ..... 10 2004 022 024

(51) Int. Cl.
*A47G 19/08* (2006.01)

(52) U.S. Cl. ..... 211/41.4

(58) Field of Classification Search ..... 211/41.3–41.6, 211/41.8, 41.9, 90.01, 150, 90.02, 106, 90.03, 211/181.1; 248/241–244, 223.41, 296.1, 248/299.1; 312/311, 348.3; 108/6; D32/3
See application file for complete search history.

(56) References Cited

U.S. PATENT DOCUMENTS

| | | | | | |
|---|---|---|---|---|---|
| 2,379,975 | A | * | 7/1945 | Luger | 211/99 |
| 2,500,559 | A | * | 3/1950 | Miller | 182/121 |
| 2,841,288 | A | * | 7/1958 | Field et al. | 211/41.4 |
| 3,561,713 | A | * | 2/1971 | Berkowitz | 248/242 |
| 3,744,646 | A | * | 7/1973 | Duncan et al. | 211/162 |
| 3,752,322 | A | * | 8/1973 | Fiocca et al. | 211/41.8 |
| 4,046,261 | A | * | 9/1977 | Yake | 211/41.8 |
| 4,577,092 | A | * | 3/1986 | Lenoir | 392/418 |
| 4,606,464 | A | * | 8/1986 | Jordan et al. | 211/41.8 |
| 4,917,248 | A | * | 4/1990 | Friskney | 211/41.8 |
| 5,062,605 | A | * | 11/1991 | Muhlethaler | 248/68.1 |
| 5,205,419 | A | * | 4/1993 | Purtilo | 211/41.8 |
| 5,332,105 | A | * | 7/1994 | Stanfield | 211/41.4 |
| 5,351,837 | A | * | 10/1994 | Smith | 211/41.8 |
| 5,480,035 | A | * | 1/1996 | Smith | 211/41.8 |
| 5,483,902 | A | * | 1/1996 | Grosch | 108/143 |
| 5,513,910 | A | * | 5/1996 | Ellingwood et al. | 312/405.1 |
| 5,601,195 | A | * | 2/1997 | Finola et al. | 211/41.8 |
| 5,657,878 | A | * | 8/1997 | Austin | 211/41.8 |
| 5,749,480 | A | * | 5/1998 | Wood | 211/169.1 |
| 5,816,419 | A | * | 10/1998 | Lamson | 211/150 |

(Continued)

*Primary Examiner*—Jennifer E. Novosad

(57) ABSTRACT

The present invention relates to a basket (1) for a dishwashing machine having various receptacles and/or holders for plates or cups whereby in particular a cup support (3) comprises a shelf pivotably mounted in the basket (1) and assuming a horizontal position to form a second supporting surface about hinge points hinge points (4, 5) provided on the basket. To increase the shelf layers of the cup support (3) the hinge points (4, 5) are mounted on the basket (1) in such a way that they are variable in height.

6 Claims, 1 Drawing Sheet

U.S. PATENT DOCUMENTS 5,840,261 A * 11/1998 Monch ..... 422/300
5,860,716 A * 1/1999 Good et al. ..... 312/311
5,918,749 A * 7/1999 Pille et al. ..... 211/41.9
6,189,847 B1 * 2/2001 Hart ..... 248/220.31
6,234,328 B1 * 5/2001 Mason ..... 211/90.02
6,290,075 B1 * 9/2001 Cheimets et al. ..... 211/90.03
6,546,942 B2 * 4/2003 Smith et al. ..... 134/201
6,571,965 B1 * 6/2003 Beck et al. ..... 211/41.8
6,848,585 B2 * 2/2005 VanLandingham ..... 211/41.9
6,974,040 B2 * 12/2005 Jahrling ..... 211/41.8
7,231,929 B2 * 6/2007 Landsiedel et al. ..... 134/135
7,249,680 B2 * 7/2007 Wang ..... 211/37
7,410,228 B2 * 8/2008 Dickson et al. ..... 312/311
7,418,967 B2 * 9/2008 Kim ..... 134/57 D
2003/0075517 A1 * 4/2003 Jahrling ..... 211/41.8
2003/0089672 A1 * 5/2003 VanLandingham ..... 211/41.8
2004/0124327 A1 * 7/2004 Cheng ..... 248/244
2006/0108298 A1 * 5/2006 Kim ..... 211/41.8
2006/0237379 A1 * 10/2006 Yang et al. ..... 211/41.4
2007/0039904 A1 * 2/2007 Purushothaman ..... 211/41.8
2007/0247039 A1 * 10/2007 Anderson et al. ..... 312/228.1
2008/0083678 A1 * 4/2008 Graute ..... 211/41.8
2008/0135505 A1 * 6/2008 Frankel et al. ..... 211/41.4
2008/0303740 A1 * 12/2008 Schipper et al. ..... 343/878

* cited by examiner

BASKET FOR A DISHWASHING MACHINE HAVING VARIOUS RECEPTACLES AND/OR HOLDERS

FIELD OF THE INVENTION

The present invention relates to a basket for a dishwashing machine having various receptacles and/or holders for plates or cups, whereby the cup support in particular comprises a shelf pivotably mounted in the basket, assuming a horizontal position to form a second support surface about hinge points provided on the basket.

BACKGROUND OF THE INVENTION

An upper basket is known in particular from the state of the art, for example, a dishwashing machine G 641 PLUS that is manufactured and distributed by the present applicant, said upper basket comprising a cup support on its side wall, where the cup support is pivotably mounted on the basket. Pivoting reveals a second shelf in the area of the basket for depositing cups, so that coffee cups, bowls or the like can be stacked one above the other in the basket. For example, if this cup support is also to be used for tall glasses or bowls, there is the possibility of folding up the cup support so that the entire area can be used as storage space.

With this known cup support, it is regarded as a disadvantage that the possibility of variation is limited with this pivotable cup support because only two possible shelf adjustments are possible.

SUMMARY OF THE INVENTION

The invention is thus based on the problem of improving upon a pivotable cup support so that its shelf adjustment can be varied.

This problem is solved according to this invention by the features described in claim 1. Advantageous embodiments and refinements of the invention are derived from the following dependent claims.

The advantages that can be achieved with the present invention are derived from the fact that the hinge points about which the cup support can be pivoted allow an adjustment of the level, which results in additional levels where various utensils can be accommodated in the area of the cup support.

The hinge points are therefore guided in a molded connecting link and can be secured in various positions. To ensure dimensionally stable repositioning of the cup support, the molded connecting link comprises an essentially straight channel-like portion oriented vertically, where the hinge point can be shifted from a lower level to a higher level or set back. A curved eye-shaped portion oriented essentially horizontally is connected at each end of the vertically oriented portion, the horizontal portion being shaped and designed so that the hinge point remains engaged in this area. This provides an upper and a lower end portion in the molded connecting link in which the cup support is held pivotably and lockably.

In a preferred embodiment, noses are formed in the eye-shaped portion, extending around or behind the hinge point, and there are supporting areas in the channel-like portions against which the hinge point is supported at the rear. On the basis of this design, this provides an area in the connecting link in which the hinge point is held in a stable manner. To do so, according to a first embodiment, it is proposed that the hinge point in the molded connecting link comprises a wire loop that is connected to the cup support and is force-guided in the connecting link. The rear portion of the loop is guided exclusively in the vertically oriented portion, whereby noses are formed in the eye-shaped portion, with the front of the loop reaching around or behind the same. The rear of the loop is supported in the channel-like portion for a stable positioning of the cup support.

The hinge point as such may also comprise a pin which is guided in the connecting link, whereby the pivotably mounted cup support is connected to the pin. For assembly of the molded connecting link, it is proposed according to the present invention that the molded connecting link shall be connected to a holding plate which can be engaged between the rods forming the basket wall to secure it thereto. The connecting link and the receptacle plate may be made of a molded plastic.

DESCRIPTION OF THE DRAWINGS

An exemplary embodiment of the invention is depicted purely schematically in the figures and is described in greater detail, showing.

DETAILED DESCRIPTION OF THE INVENTION

Figure 1:
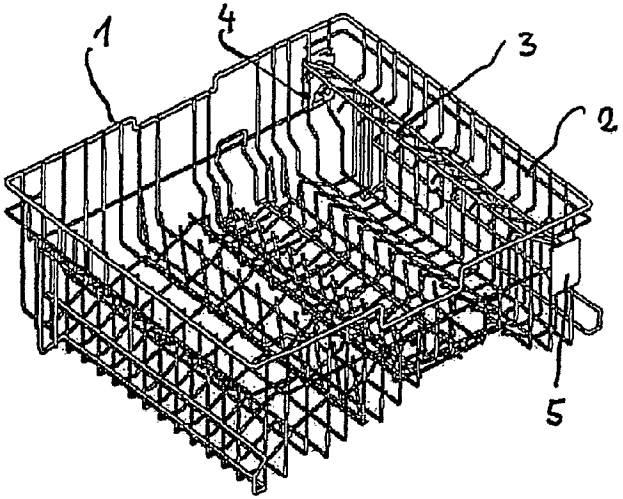
FIG. 1 is a perspective view of an upper basket.

FIG. 1 shows an upper basket 1 of a dishwasher (not shown in detail here) having various receptacles and/or holders for plates and cups. As indicated in FIG. 1, a cup support 3 is provided on the side wall of the basket 1, comprising a pivotable shelf which assumes a horizontal position around hinge points 4 and 5 provided on the basket 1 to form a second supporting surface. It is self-evident that utensils designed as tall items can be placed in the basket 1 if the cup support 3 is raised.

Figure 2:
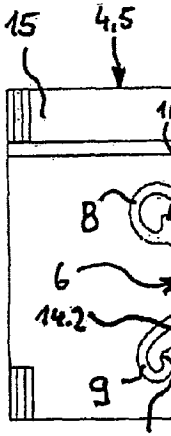
FIG. 2 illustrates a molded article in the form of a connecting link having a cup support in the first position.
Figure 3:
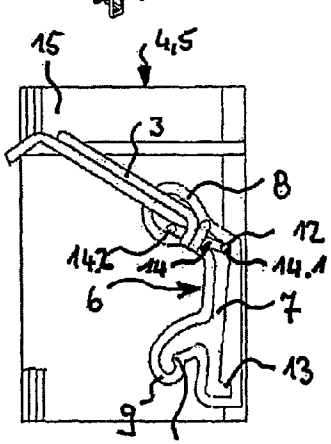
FIG. 3 is another diagram according to FIG. 2 with the cup support in a second position.
Figure 4:
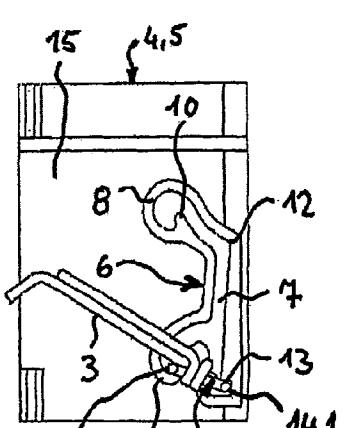
FIG. 4 is another diagram according to FIG. 2 with the cup support in a third position.

As shown by a combined consideration of FIGS. 2 through 4 in greater detail, the hinge points 4 and/or 5 are mounted at variable heights on the basket 1 for adjusting the level of the cup support 3 in the basket 1. The hinge points 4, 5 are guided in a molded connecting link 6 so that they can be secured in various positions. For example, FIG. 2 shows a cup support 3 that has been raised, where the hinge points 4, 5 are arranged in the lower portion of the molded connecting link 6. FIG. 3 shows the positioning of the cup support 3 in the upper position in the molded connecting link 6, whereas FIG. 4 shows the lower positioning of the hinge points 4, 5 in the molded connecting link 6. As also shown by a combined consideration of FIGS. 2 through 4, the molded connecting link 6 comprises an essentially straight channel 7 oriented vertically and connected at one end to curved eye-shaped portions 8 and 9 oriented essentially horizontally and shaped and designed so that the hinge points 4, 5 can be engaged in them, as is shown clearly in FIGS. 3 and 4.

As can be seen in FIG. 2, noses 10, 11 are formed in the eye-shaped areas 8, 9, engaging around and/or behind the hinge points 4, 5, whereby supporting areas 12, 13 are provided in the channel 7 and here in the reverse area with the hinge point 4, 5 supported against the supporting areas at the back.

To do so, according to a first embodiment, it is preferred that the hinge point 4, 5 in the molded connecting link 6 comprises a wire loop 14 which is connected to the cup support 3 and is forcibly guided in the connecting link 6. The rear portion 14.1 of the loop 14 is guided exclusively in the channel 7 that runs vertically, whereby noses 10 and 11 are formed in the eye-shaped portions 8 and 9, with the front portion 14.2 of the loop reaching around and/or behind said noses. The rear loop portion 14.1 is supported in the channel 7 for stable positioning of the cup support 3.

The hinge points 4, 5 may also comprise a pin which is guided in the connecting link 6, the cup support 3 being designed as wire mesh connected to the pin.

It is self-evident if, for example, the cup support 3 is to be brought from the position shown in FIG. 3 to the position shown in FIG. 2, the cup support 3 need only be pivoted upward, so that the loop 14 can be brought into the raised position along the connecting link. If the positioning in FIG. 4 is to be reached, one need only pivot the cup support 3 forward, so that the nose 10 engages behind loop 14, whereby the loop 14 is supported on the supporting area 13 on a portion of the connecting link 6, thus resulting in a stable position for the cup support 3.

The molded connecting link 6 is preferably attached to a receptacle plate 15 which can be engaged between the rods forming the basket wall to secure it (easier to see in FIG. 1). This provides a stable mounting for the molded connecting link 6 which allows the various positions of the cup support 3. The connecting link 6 and the receptacle plate 15 may be made of a molded plastic.

It is self-evident that in the case of a divided cup support, hinge points 4, 5 are provided accordingly on the ends of the divided cup support.

What is claimed is:

1. A basket for a dishwashing machine having various receptacles or holders for plates or cups, the basket comprising a cup support, the cup support connected between hinge points, the hinge points pivotably connected with the basket, the cup support capable of assuming a substantially horizontal position to form a supporting surface, the hinge points operatively connected with the basket such that the hinge points are variable in height for adjusting a level of the supporting surface, wherein each hinge point is slidably guidable in a respective channel in a connecting link coupled to the basket, each channel having an essentially straight channel portion oriented substantially vertically and comprising at least two curved eye-shaped channel portions at different respective levels with respect to the essentially straight channel portion, the eye-shaped channel portions oriented essentially horizontally and shaped such that the respective hinge point engages therein when the cup support is in the horizontal position, wherein each hinge point comprises a wire loop disposed in the respective connecting link, each wire loop being connected to the cup support and guidable in the channel of the respective connecting link, a rear portion of each wire loop being guidable in the essentially straight channel portion, and wherein the curved eye-shaped channel portions each comprise a nose with which a front portion of the respective wire loop engages when the cup support is in the horizontal position, and the channel comprises at least two supporting areas corresponding to the at least two curved eye-shaped channel portions and against which the rear portion of the wire loop is supported when the cup support is in the horizontal position.

2. A basket according claim 1, wherein the hinge points comprise a pin which is guidable in the respective channel of the connecting link and the cup support is connected to the pin.

3. A basket according to claim 2, wherein each connecting link is connected to a receptacle plate engaged between rods forming a basket wall of the basket to secure the receptacle plate thereto.

4. A basket according to claim 3, wherein the connecting link and the receptacle plate are made of a molded plastic.

5. A basket according to claim 1, wherein each connecting link is connected to a receptacle plate engaged between rods forming a basket wall of the basket to secure the receptacle plate thereto.

6. A basket according to claim 5, wherein the connecting link and the receptacle plate are made of a molded plastic.

* * * * *